US009186789B2

(12) United States Patent
Wang

(10) Patent No.: US 9,186,789 B2
(45) Date of Patent: Nov. 17, 2015

(54) OPERATING ROD ASSEMBLY FOR A TOOLBOX

(71) Applicant: Tzu-Chien Wang, Tainan (TW)

(72) Inventor: Tzu-Chien Wang, Tainan (TW)

( * ) Notice: Subject to any disclaimer, the term of this patent is extended or adjusted under 35 U.S.C. 154(b) by 138 days.

(21) Appl. No.: 14/140,500

(22) Filed: Dec. 25, 2013

(65) Prior Publication Data

US 2015/0174757 A1 Jun. 25, 2015

(51) Int. Cl.

*A45C 11/26* (2006.01)
*B25H 3/00* (2006.01)
*B65D 25/10* (2006.01)

(52) U.S. Cl.

CPC ..... *B25H 3/003* (2013.01); *B65D 25/10* (2013.01)

(58) Field of Classification Search

CPC ..... B25H 3/00; B25H 3/003; B25H 3/006; B65D 25/10
USPC ..... 206/349, 372–379, 382, 759, 762; 211/170, 70.6, 78
See application file for complete search history.

(56) References Cited

U.S. PATENT DOCUMENTS

| | | | | |
|---|---|---|---|---|
| 6,119,859 | A * | 9/2000 | Wen | 206/379 |
| 6,398,027 | B1 * | 6/2002 | Ryu | 206/362 |
| 2006/0243617 | A1 * | 11/2006 | Brunson et al. | 206/349 |
| 2010/0032327 | A1 * | 2/2010 | Lai | 206/375 |
| 2015/0068937 | A1 * | 3/2015 | Jiang et al. | 206/349 |

* cited by examiner

*Primary Examiner* — Luan K Bui
*Assistant Examiner* — Rafael Ortiz

(57) ABSTRACT

A toolbox includes a base receiving a supporting seat having a first pivotal portion with a positioning protrusion. A limiting protrusion is formed between the positioning protrusion and a groove. A socket includes a second pivotal portion pivotably connected to the first pivotal portion. An operating rod is received in the socket and is pivotable together with the socket between a storage position and two extended positions. The positioning protrusion is selectively engaged in one of three positioning grooves in the second pivotal portion. The socket includes a first sidewall having a resilient tongue with a protrusion engaged in an annular groove of the operating rod. The second socket further includes a second sidewall having a through-hole through which the limiting protrusion can extend. A projection is formed on the second sidewall and is engaged in the groove of the supporting seat when the socket is in the storage position.

4 Claims, 9 Drawing Sheets

A - A

OPERATING ROD ASSEMBLY FOR A TOOLBOX

BACKGROUND OF THE INVENTION

The present invention relates to an operating rod assembly for a toolbox and, more particularly, to an operating rod assembly for a toolbox that can be stably held in a storage position and that can easily be moved to at least one extended position for use.

A toolbox generally receives a plurality of tool bits of different sizes and shapes and an operating rod for selectively coupling one of the tool bits and for coupling with a tool. FIG. 7 shows a conventional toolbox 1' receiving a plurality of tool bits 11'. The toolbox 1' further includes a retaining member 12' for holding an operating rod 13'. The operating rod 13' includes an engagement end 131' at a front end thereof. The engagement end 131' can have different lengths and can be selectively coupled with one of the tool bits 11'. The operating rod 13' further includes a coupling end 132' at a rear end thereof. The coupling end 132' has a fixed length and can be coupled with a power tool. An example of such a toolbox is disclosed in U.S. Patent Application No. 2008/0149678 A1. However, a user must extend his or her hand into the toolbox 1' to retrieve the operating rod 13', which is inconvenient in use. Furthermore, the operating rod 13' is apt to fall and impacts an inner wall of the toolbox 1' if the holding effect provided by the retaining member 12' is not stable.

FIG. 8 shows another conventional toolbox including a base 2' and a receptacle 21' pivotably mounted to the base 2'. A tubular stub 23' is mounted in the receptacle 21' and can be coupled with an operating rod 22'. When the toolbox is opened, the receptacle 21' can be pivoted to an extended position allowing easy retrieval of the operating rod 22' for use. An example of such a toolbox is disclosed in U.S. Patent Application No. 2010/0032327 A1. However, the operating rod 22' is still apt to disengage from the tubular stub 23' if the toolbox is subjected to vibrations during carriage, because the operating rod 22' is simply held in place by friction fit between the operating rod 22' and the tubular stub 23'. Furthermore, when the receptacle 21' is in an extended position relative to the base 2', it is difficult to retain the receptacle 21' in a fixed angular position relative to the base 2', failing to provide easy retrieval of the operating rod 22'.

BRIEF SUMMARY OF THE INVENTION

An objective of the present invention is to provide an operating rod assembly for a toolbox, wherein the operating rod can be stably held in a storage position and can easily be moved to at least one extended position for use.

A toolbox according to the present invention includes a base and a cover for closing or opening the base. An operating rod is removably received in the toolbox. The operating rod is an elongated member and includes a coupling end having an annular groove. The coupling end of the operating rod is adapted to be coupled to a tool. The operating rod further includes an engagement end adapted for engaging with a tool bit. The base receives a supporting seat and a socket.

The supporting seat includes a coupling section. The coupling section includes a first end having a supporting face. The coupling section further includes a second end spaced from the first side in a length direction and having a first pivotal portion. The first pivotal portion includes a resilient positioning portion aligned with the supporting face in the length direction. The resilient positioning portion includes a positioning protrusion. A limiting protrusion is formed between the positioning protrusion and the supporting face. The supporting seat further includes a groove extending in the length direction. The limiting protrusion is located between the groove and the positioning protrusion.

The socket includes a first end having a second pivotal portion pivotably connected to the first pivotal portion of the supporting seat. The socket is pivotable relative to the supporting seat between a storage position and first and second extended positions. The operating rod is removably received in the coupling section. The operating rod is pivotable together with the socket between the storage position and the first and second extended positions. The engagement end of the operating rod is aligned with and supported at the supporting face when the socket is in the storage position. The limiting protrusion is engaged in the annular groove of the operating rod when the socket is in the storage position. The socket further includes a second end. The socket further includes a receptacle in an intermediate portion between the first and second ends thereof. The receptacle has an opening in the second end of the socket. The coupling end of the operating rod is received in the receptacle of the socket via the opening. The second pivotal portion includes an outer periphery having first, second, and third positioning grooves located in different angular locations. The positioning protrusion is releasably engaged in one of the plurality of positioning grooves corresponding to the storage position and the first and second extended positions of the socket. The socket further includes first and second sidewalls delimiting the receptacle. The first sidewall includes a slit, forming a resilient tongue surrounded by the slit. The resilient tongue includes a protrusion. The protrusion is engaged in the annular groove of the operating rod. The second sidewall includes a through-hole aligned with the protrusion on the first sidewall. The limiting protrusion extends through the through-hole of the second sidewall and is engaged in the annular groove of the operating rod when the socket is in the storage position. The second sidewall further includes a projection. The through-hole is located between the projection and the second pivotal portion. The projection is engaged in the groove of the supporting seat when the socket is in the storage position.

In a form shown, the second positioning groove is located between the first positioning groove and the third positioning groove. The socket is located in the storage position when the positioning protrusion is engaged in the first positioning groove. The outer periphery of the second pivotal portion further includes a limiting face. The third positioning groove is located between the second positioning groove and the limiting face. The limiting face abuts against the resilient positioning portion when the positioning protrusion is engaged in the third positioning groove. The socket is at an angle of 45 degrees to the supporting face when the positioning protrusion is engaged in the second positioning groove. The socket is at an angle of 90 degrees to the supporting face when the positioning protrusion is engaged in the third positioning groove. The first pivotal portion of the supporting seat includes two upright walls extending perpendicularly from the supporting face and facing each other. Each upright wall includes a peg on an inner side thereof. The second pivotal portion of the socket is pivotably received between the upright walls. The second pivotal portion includes a pivot hole receiving the pegs of the upright walls.

The annular groove of the operating rod is engaged with the protrusion and the limiting protrusion aligned with the protrusion, securely retaining the operating rod in the receptacle when in the storage position. Furthermore, the projection engaged in the groove extending in the length direction prevents wobbling of the socket relative to the supporting seat in a width direction perpendicular to the length direction, providing enhanced stability while carrying the toolbox.

When it is desired to retrieve the operating rod, the socket is pivoted relative to the supporting seat to a position at an angle of 45 or 90 degrees to the supporting seat (the second positioning groove or the third positioning groove is engaged with the positioning protrusion). Since the limiting protrusion has disengaged from the annular groove of the operating rod, a user can remove the operating rod from the receptacle, and the resiliency of resilient tongue allows the annular groove of the operating rod to easily disengage from the protrusion. Thus, the operating rod can smoothly be retrieved. Furthermore, the operating rod can be pivoted together with the socket to a desired extended position according to the need of the user, providing utility convenience and wider applications.

The present invention will become clearer in light of the following detailed description of illustrative embodiments of this invention described in connection with the drawings.

DETAILED DESCRIPTION OF THE INVENTION

Figure 1:
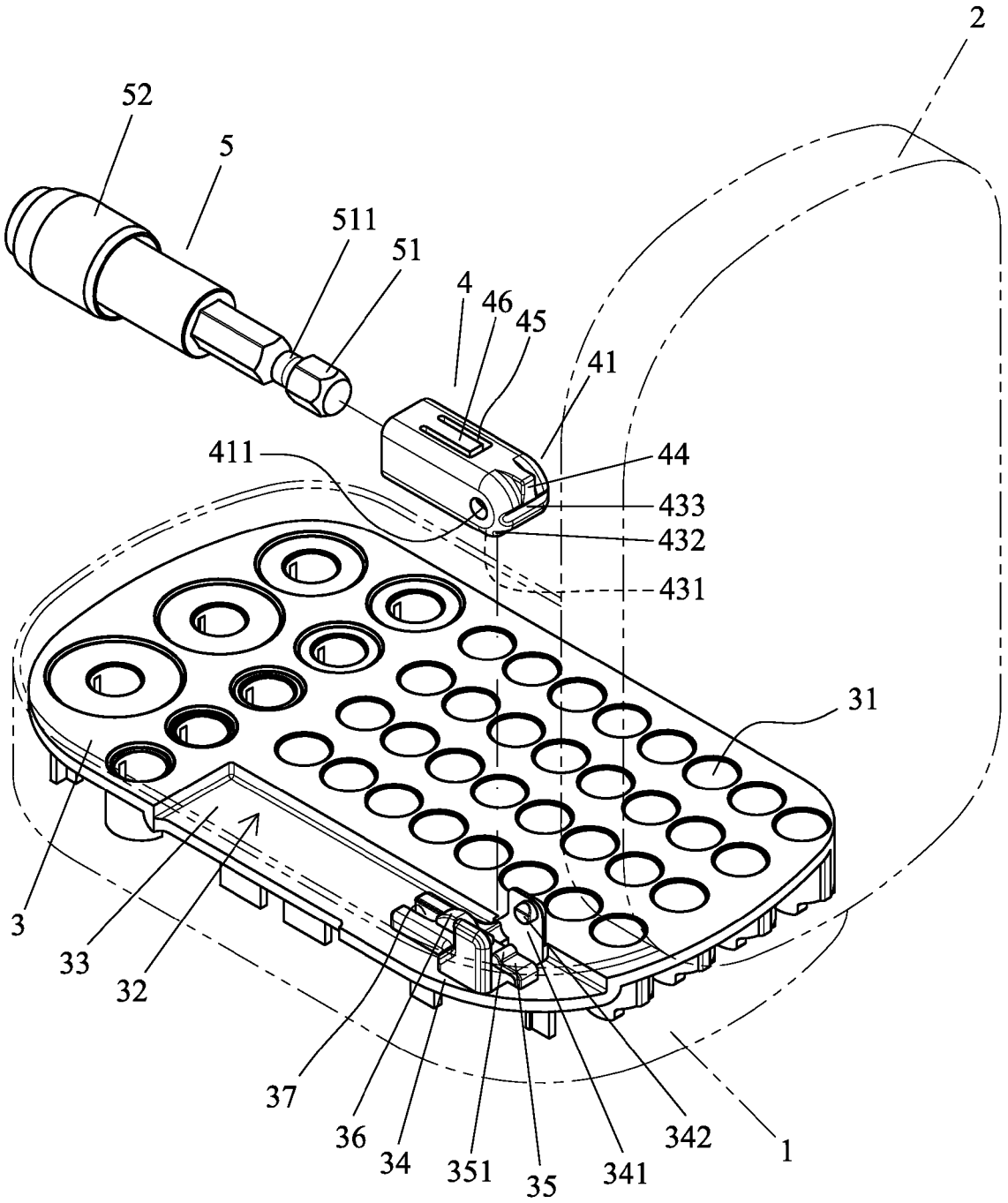
FIG. 1 is a partly exploded perspective view of a toolbox according to the present invention.
Figure 2:
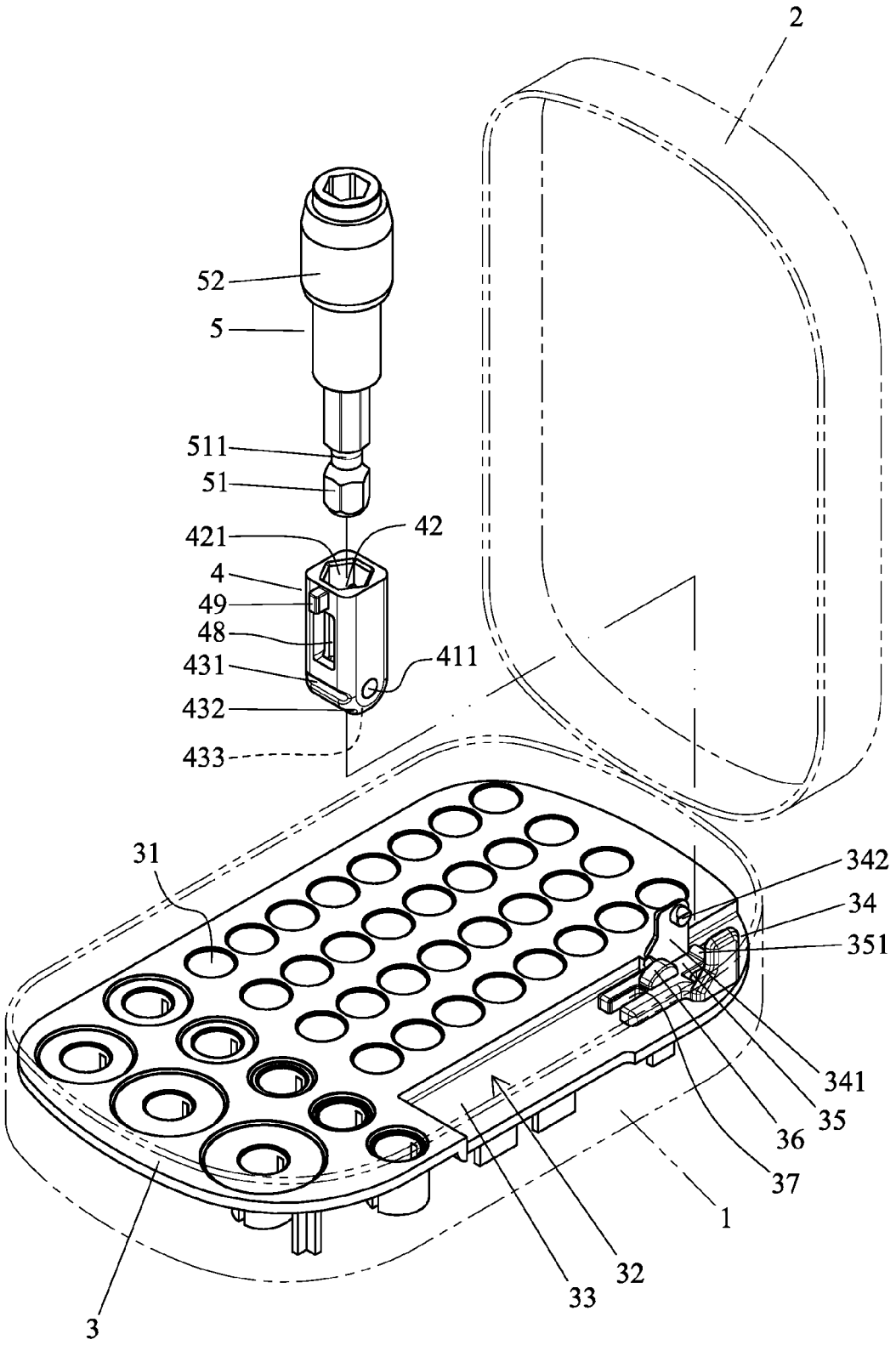
FIG. 2 is another partly exploded perspective view of the toolbox according to the present invention.
Figure 3:
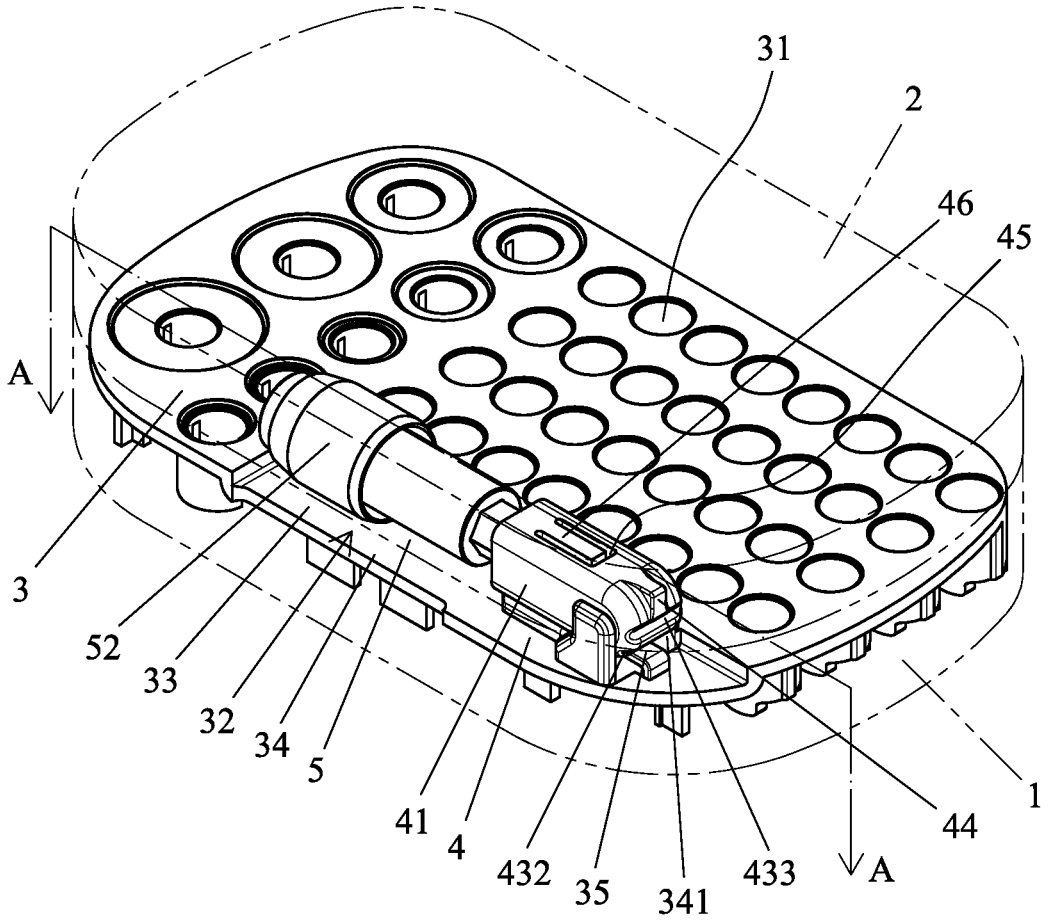
FIG. 3 is a perspective view of the toolbox according to the present invention, with a cover in a closed position.

With reference to FIGS. 1-4, a toolbox according to the present invention includes a base 1 and a cover 2 for closing or opening the base 1. The base 1 receives a supporting seat 3 and a socket 4. The supporting seat 3 is made of a flexible material and integrally formed to include a plurality of receptacles 31 for receiving tool bits (not shown) and to include a coupling section 32 for receiving an operating rod 5. The operating rod 5 is an elongated member and includes a coupling end 51 having an annular groove 511. The coupling end 51 of the operating rod 5 is adapted to be coupled to a tool (not shown), such as a power tool. The operating rod 5 further includes an engagement end 52 is adapted for engaging with a tool bit.

The coupling section 32 of the supporting seat 3 includes a first end having a supporting face 33. The coupling section 32 further includes a second end spaced from the first side in a length direction and having a first pivotal portion 34. In the form shown, the first pivotal portion 34 of the supporting seat 3 includes two upright walls 341 extending perpendicularly from the supporting face 33 and facing each other. Each upright wall 341 includes a peg 342 on an inner side thereof. The first pivotal portion 34 includes a resilient positioning portion 35 aligned with the supporting face 33 in the length direction and located between the upright walls 341. The resilient positioning portion 35 includes a positioning protrusion 351. A limiting protrusion 36 is formed between the positioning protrusion 351 and the supporting face 33. The supporting seat 3 further includes a groove 37 extending in the length direction. The limiting protrusion 36 is located between the groove 37 and the positioning protrusion 351.

The socket 4 includes a first end having a second pivotal portion 41 pivotably connected to the first pivotal portion 34 of the supporting seat 3. The second pivotal portion 41 of the socket 4 is pivotably received between the upright walls 341. The second pivotal portion 41 includes a pivot hole 411 receiving the pegs 342 of the two upright walls 341. The socket 4 is pivotable relative to the supporting seat 3 between a storage position and first and second extended positions. The operating rod 5 is removably received in the coupling section 32 and is pivotable together with the socket 4 between the storage position and the first and second extended positions. The engagement end 52 of the operating rod 5 is aligned with and supported at the supporting face 33 when the socket 4 is in the storage position. The engagement end 52 of the operating rod 5 can be supported above the supporting face 33 or can directly rest on the supporting face 33. The limiting protrusion 36 is engaged in the annular groove 511 of the operating rod 5 when the socket 4 is in the storage position. The socket 4 further includes a second end. The socket 4 further includes a receptacle 42 in an intermediate portion between the first and second ends thereof. The receptacle 42 has an opening 421 in the second end of the socket 4. The coupling end 51 of the operating rod 5 is received in the receptacle 42 of the socket 4 via the opening 421. The second pivotal portion 41 includes an outer periphery having first, second, and third positioning grooves 431, 432, 433 located in different angular locations. The positioning protrusion 351 is releasably engaged in one of the positioning grooves 431, 432, 433 corresponding to the storage position and the first and second extended positions of the socket 4.

Figure 4:
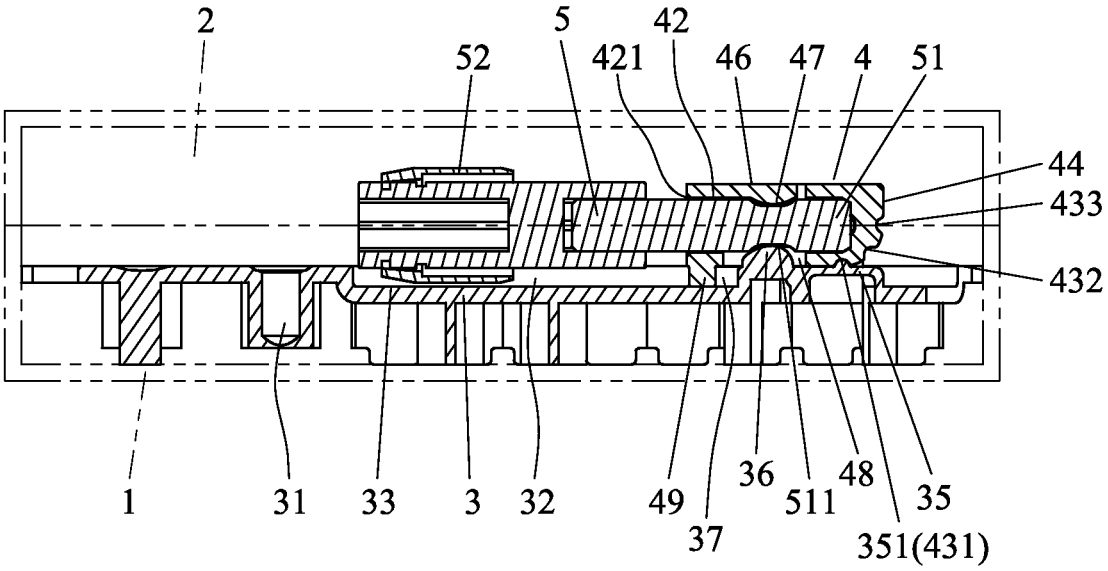
FIG. 4 is a cross sectional taken along section line A-A of FIG. 3.

The socket 4 further includes first and second sidewalls delimiting the receptacle 45. The first sidewall including a slit 45, forming a resilient tongue 46 surrounded by the slit 45. The resilient tongue 46 includes a protrusion 47 (FIG. 4). The protrusion 47 is engaged in the annular groove 511 of the operating rod 5. The second sidewall includes a through-hole 48 aligned with the protrusion 47 on the first sidewall. The limiting protrusion 36 extends through the through-hole 48 of the second sidewall and is engaged in the annular groove 511 of the operating rod 5 when the socket 4 is in the storage position. The second sidewall further includes a projection 49. The through-hole 48 is located between the projection 49 and the second pivotal portion 41. The projection 49 is engaged in the groove 37 of the supporting seat 3 when the socket 4 is in the storage position.

In the form shown, the second positioning groove 432 is located between the first positioning groove 431 and the third positioning groove 433. The socket 4 is located in the storage position when the positioning protrusion 351 is engaged in the first positioning groove 431. The outer periphery of the second pivotal portion 41 further includes a limiting face 44 to limit the maximal angle of the socket 4 relative to the supporting seat 3. The third positioning groove 433 is located between the second positioning groove 432 and the limiting face 44. The limiting face 44 abuts against the resilient positioning portion 35 when the positioning protrusion 351 is engaged in the third positioning groove 433. The socket 4 is at an angle of 45 degrees to the supporting face 33 when the positioning protrusion 351 is engaged in the second positioning groove 432. The socket 4 is at an angle of 90 degrees to the supporting face 33 when the positioning protrusion 351 is engaged in the third positioning groove 433.

The second pivotal portion 41 of the socket 4 is pivotably connected to the first pivotal portion 34 of the supporting seat 3. The coupling end 51 of the operating rod 5 is inserted into the receptacle 42 of the socket 4 via the opening 421. The resilient tongue 46 flexes to allow engagement of the protrusion 47 in the annular groove 511 for positioning the operating rod 5. As can be seen from FIG. 4, the positioning protrusion 351 is engaged in the first positioning groove 431 of the socket 4 when the socket 4 and the operating rod 5 are in the storage position. The engagement end 52 of the operating rod 5 is aligned with the supporting face 33. The limiting protrusion 36 of the supporting seat 3 extends through the through-hole 48 of the socket 4 into the annular groove 511 of the operating rod 5. Furthermore, the projection 49 of the socket 4 is engaged in the groove 37 of the supporting seat 3. Thus, the annular groove 511 of the operating rod 5 is engaged with the protrusion 47 and the limiting protrusion 36 aligned with the protrusion 47, securely retaining the operating rod 5 in the receptacle 42 when in the storage position. Furthermore, the projection 49 engaged in the groove 37 extending in the length direction prevents wobbling of the socket 4 relative to the supporting seat 3 in a width direction perpendicular to the length direction, providing enhanced stability while carrying the toolbox.

Figure 5:
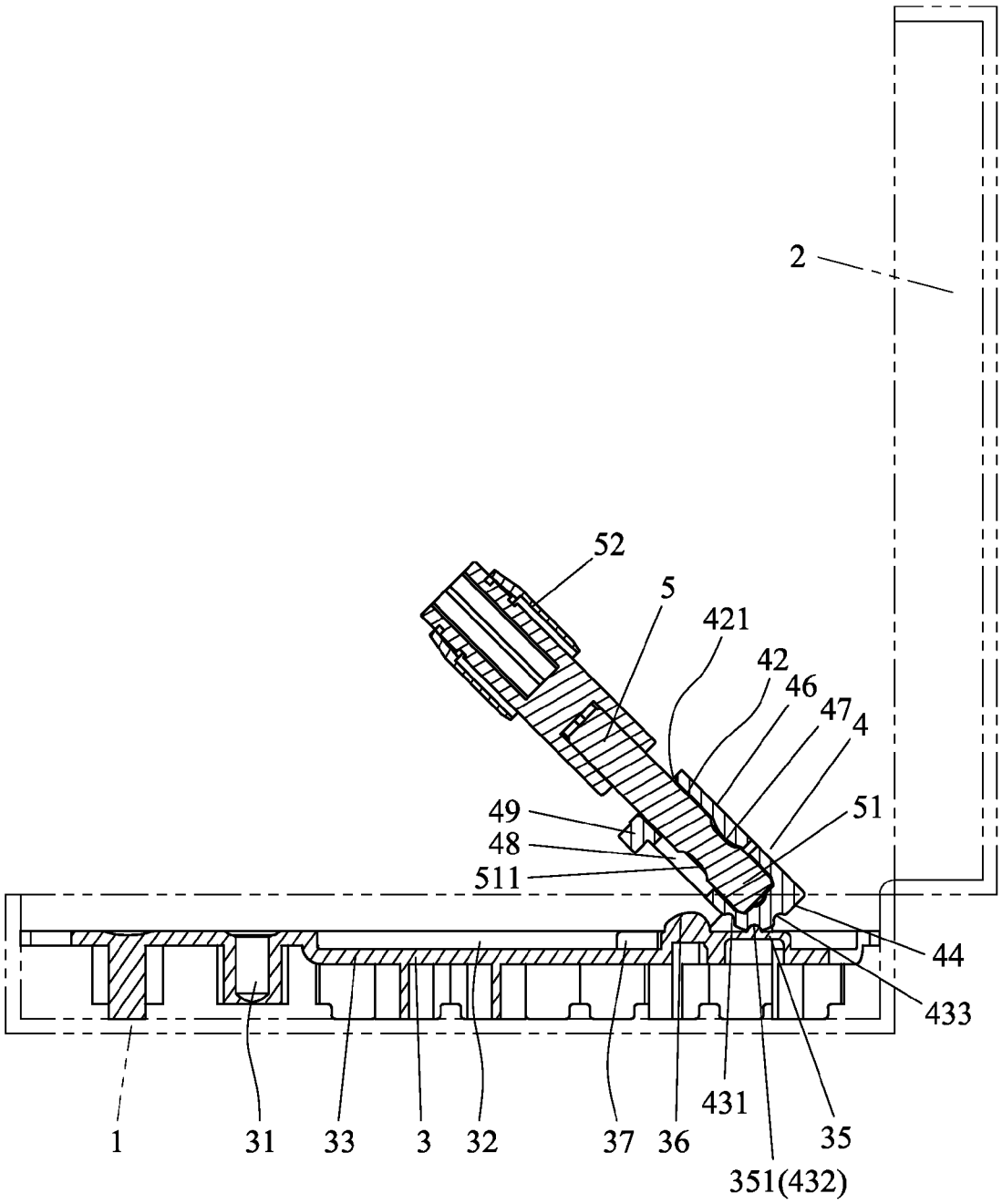
FIG. 5 is a view similar to FIG. 4, with the cover opened and with a socket in an extended position.
Figure 6:
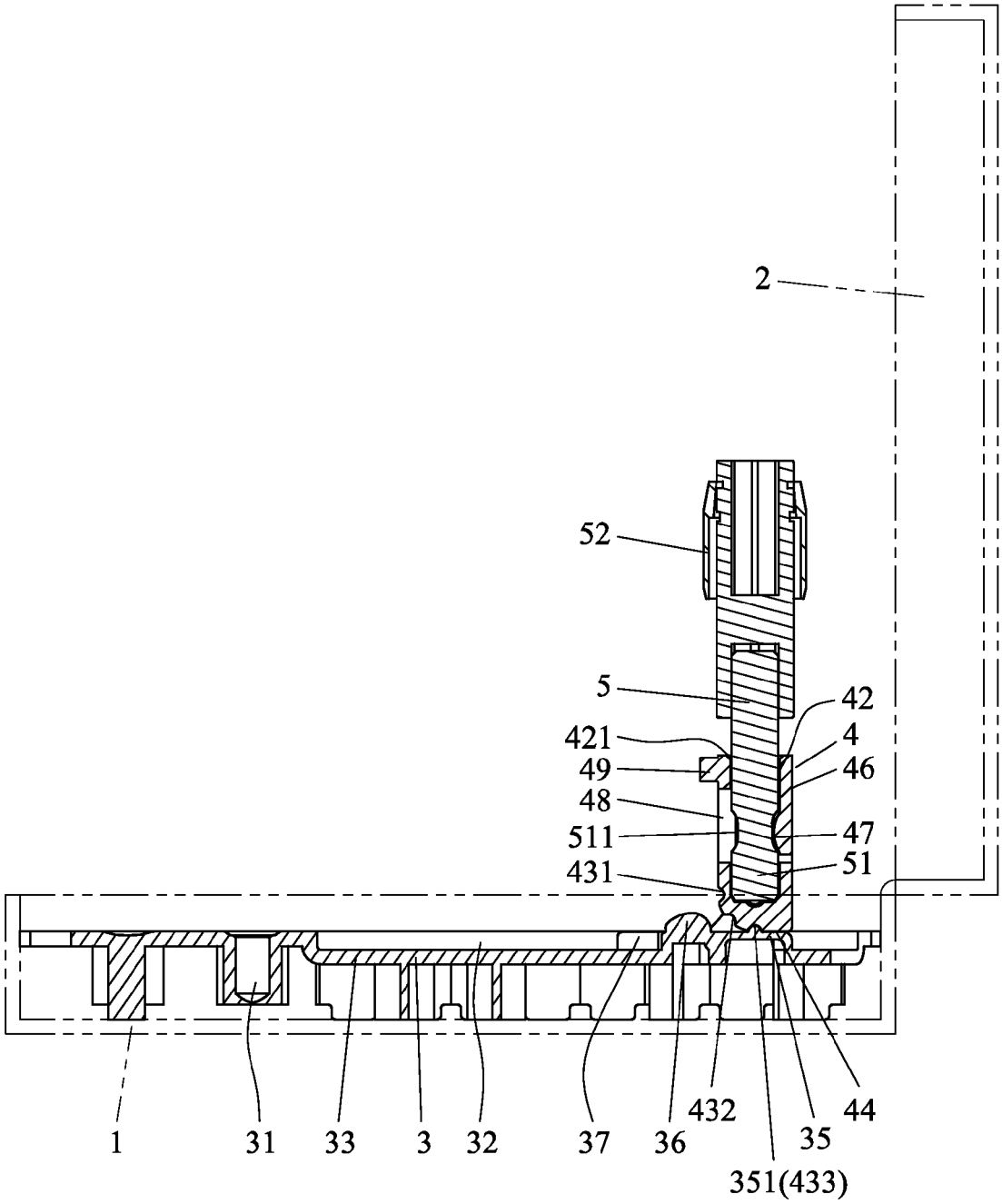
FIG. 6 is a view similar to FIG. 5, with the socket in another extended position.
Figure 7:
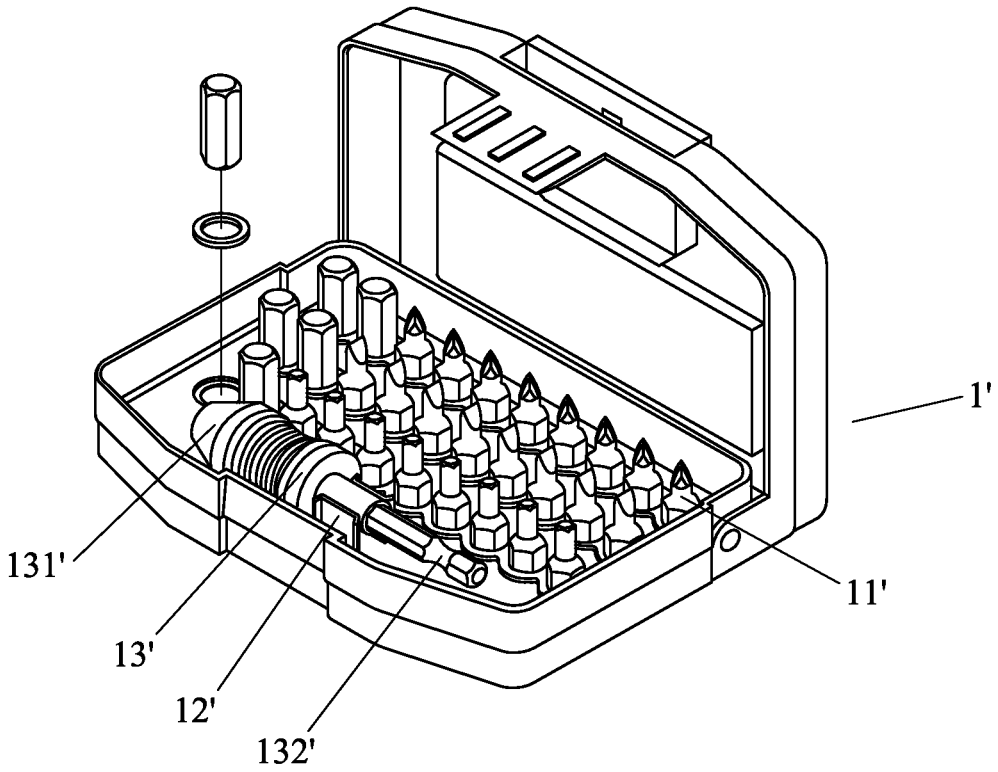
PRIOR ART F I G . 7
FIG. 7 is a perspective view of a conventional toolbox.
Figure 8:
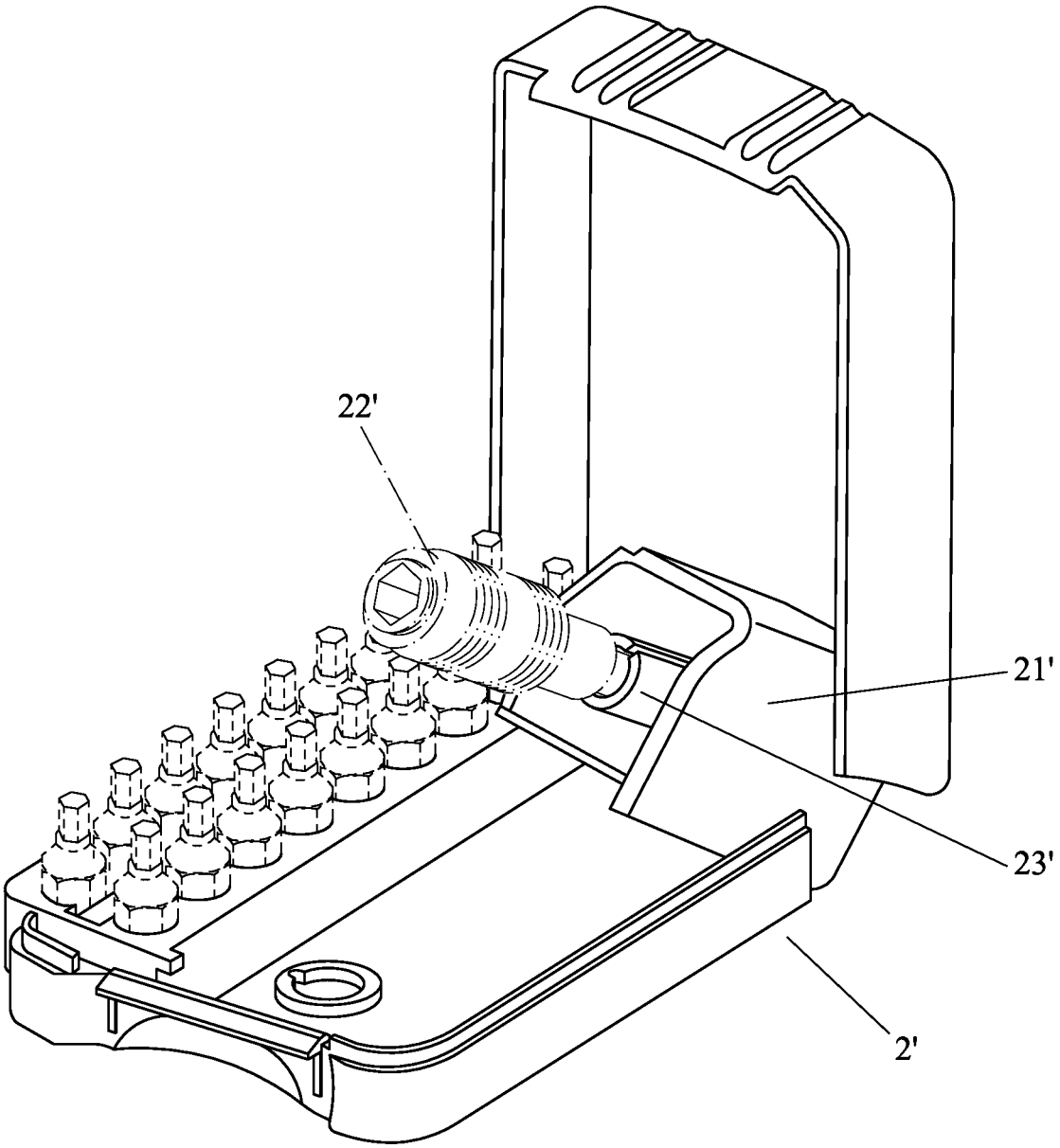
PRIOR ART F I G . 8
FIG. 8 is a perspective view of another conventional toolbox.
Figure 9:
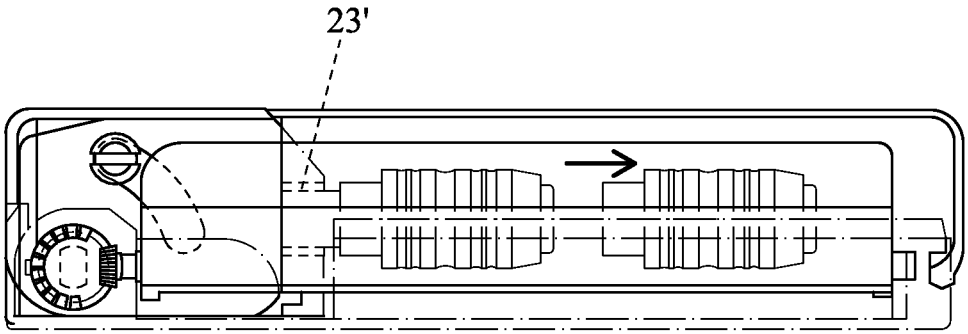
PRIOR ART F I G . 9
FIG. 9 is a cross sectional view of the conventional toolbox of FIG. 8.

When it is desired to retrieve the operating rod 5, the socket 4 is pivoted relative to the supporting seat 3 to a position at an angle of 45 degrees to the supporting seat 3 (the second positioning groove 432 is engaged with the positioning protrusion 351, see FIG. 5) or to an upright position at an angle of 90 degrees to the supporting seat 34 (the third positioning groove 433 is engaged with the positioning protrusion 351, see FIG. 6). Since the limiting protrusion 36 has disengaged from the annular groove 511 of the operating rod 5, a user can remove the operating rod 5 from the receptacle 42, and the resiliency of resilient tongue 6 allows the annular groove 511 of the operating rod 5 to easily disengage from the protrusion 47. Thus, the operating rod 5 can smoothly be retrieved. Furthermore, the operating rod 5 can be pivoted together with the socket 4 to a desired extended position according to the need of the user, providing utility convenience and wider applications. Furthermore, when the socket 4 is pivoted to the maximum angular position relative to the supporting seat 3 (FIG. 6), the limiting face 44 of the socket 4 abuts against the resilient positioning portion 35 to retain the socket 4 in the maximum angular position, assuring enhanced operational stability.

In view of the foregoing, the toolbox according to the present invention can largely increase the assembling stability of the operating rod 5 in the storage position, preventing the operating rod 5 from disengaging from the socket 4 during carriage of the toolbox. Furthermore, the socket 4 and the operating rod 5 have more than one extended position to allow easy retrieval of the operating rod 5, providing use convenience of the operating rod 5.

Although specific embodiments have been illustrated and described, numerous modifications and variations are still possible without departing from the scope of the invention. The scope of the invention is limited by the accompanying claims.

The invention claimed is:

1. A toolbox comprising a base and a cover for closing or opening the base, with an operating rod removably received in the toolbox, with the operating rod being an elongated member and including a coupling end having an annular groove, with the coupling end of the operating rod adapted to be coupled to a tool, with the operating rod further including an engagement end adapted for engaging with a tool bit, with the base receiving: a supporting seat including a coupling section, with the coupling section including a first end having a supporting face, with the coupling section further including a second end spaced from a first side in a length direction and having a first pivotal portion, with the first pivotal portion including a resilient positioning portion aligned with the supporting face in the length direction, with the resilient positioning portion including a positioning protrusion, with a limiting protrusion formed between the positioning protrusion and the supporting face, with the supporting seat further including a groove extending in the length direction, with the limiting protrusion located between the groove and the positioning protrusion; and a socket including a first end having a second pivotal portion pivotably connected to the first pivotal portion of the supporting seat, with the socket pivotable relative to the supporting seat between a storage position and first and second extended positions, with the operating rod removably received in the coupling section, with the operating rod pivotable together with the socket between the storage position and the first and second extended positions, with the engagement end of the operating rod aligned with and supported at the supporting face when the socket is in the storage position, with the limiting protrusion engaged in the annular groove of the operating rod when the socket is in the storage position, with the socket further including a second end, with the socket further including a receptacle in an intermediate portion between the first and second ends thereof, with the receptacle having an opening in the second end of the socket, with the coupling end of the operating rod received in the receptacle of the socket via the opening, with the second pivotal portion including an outer periphery having first, second, and third positioning grooves located in different angular locations, with the positioning protrusion releasably engaged in one of the plurality of positioning grooves corresponding to the storage position and the first and second extended positions of the socket, with the socket further including first and second sidewalls delimiting the receptacle, with the first sidewall including a slit, forming a resilient tongue surrounded by the slit, with the resilient tongue including a protrusion, with the protrusion engaged in the annular groove of the operating rod, with the second sidewall including a through-hole aligned with the protrusion on the first sidewall, with the limiting protrusion extending through the through-hole of the second sidewall and engaged in the annular groove of the operating rod when the socket is in the storage position, with the second sidewall further including a projection, with the through-hole located between the projection and the second pivotal portion, and with the projection engaged in the groove of the supporting seat when the socket is in the storage position.

2. The toolbox as claimed in claim 1, with the second positioning groove located between the first positioning groove and the third positioning groove, with the socket located in the storage position when the resilient positioning protrusion is engaged in the first positioning groove, with the outer periphery of the second pivotal portion further including a limiting face, with the third positioning groove located between the second positioning groove and the limiting face, and with the limiting face abutting against the positioning portion when the positioning protrusion is engaged in the third positioning groove.

3. The toolbox as claimed in claim 1, with the socket being at an angle of 45 degrees to the supporting face when the positioning protrusion is engaged in the second positioning groove, and with the socket being at an angle of 90 degrees to the supporting face when the positioning protrusion is engaged in the third positioning groove.

4. The toolbox as claimed in claim 2, with the first pivotal portion of the supporting seat including two upright walls extending perpendicularly from the supporting face and facing each other, with each of the two upright walls including a peg on an inner side thereof, with the second pivotal portion of the socket pivotably received between the two upright walls, with the second pivotal portion including a pivot hole receiving the pegs of the two upright walls.

* * * * *